United States Patent [19]

Brash

[11] 4,286,548

[45] Sep. 1, 1981

[54] GAS RECIRCULATION APPARATUS WITH INTEGRAL ASH HOPPERS

[76] Inventor: Leslie O. Brash, 8810 Concord Dr., Westfield Center, Ohio 44251

[21] Appl. No.: 95,918

[22] Filed: Nov. 19, 1979

[51] Int. Cl.[3] ..... F22B 33/00

[52] U.S. Cl. ..... 122/1 R; 110/204

[58] Field of Search ..... 122/1 R, 4 R; 110/204, 110/205; 431/115, 116

[56] References Cited

U.S. PATENT DOCUMENTS

| | | | |
|---|---|---|---|
| 3,267,908 | 8/1966 | Sitaran | 110/205 X |
| 3,310,036 | 3/1967 | Frendberg et al. | 122/1 R |
| 3,426,734 | 2/1969 | Rickard et al. | 110/205 X |
| 4,182,274 | 1/1980 | Williams | 110/204 X |

*Primary Examiner*—Edward G. Favors

*Attorney, Agent, or Firm*—R. J. Edwards; R. C. Mai

[57] ABSTRACT

An apparatus for removing particulate matter from a flue gas stream exiting a vapor generator and recirculating said gas back to the generator. The apparatus includes a back face, a bottom face and a recirculation duct. The recirculation duct is located in front of the apparatus, thereby increasing the access area in the vicinity of the generator burners and facilitating maintenance of said burners. The back face, bottom face and recirculation duct envelope ash hoppers and other internal components of the apparatus.

3 Claims, 3 Drawing Figures

GAS RECIRCULATION APPARATUS WITH INTEGRAL ASH HOPPERS

TECHNICAL FIELD

The invention relates to vapor generators in general and more specifically to an apparatus for recirculating a portion of a flue gas stream back to the generator.

BACKGROUND ART

In the design and operation of modern high capacity vapor generating units, the recirculation of combustion gases is commonly employed as a means for altering the heat absorption pattern within the vapor generator to effect substantially constant outlet steam temperature conditions over a wide load range. The gas to be recirculated is generally withdrawn from a relatively cool region of the vapor generator (usually downstream from the economizer) and is reintroduced into the boiler by means of a suitable gas recirculation system including a fan and associated duct work.

Where coal or other high ash fuel is burned in the generator, the gaseous combustion products leaving the generator contain significant quantities of particulate matter which, if carried over into the gas recirculation system (or for that matter, into any other subsequent flue gas flow system), may precipitate serious erosion problems and, in addition, pollution problems as well.

As a consequence, it has been the industry practice to force the flue gas stream to undergo a drastic change in direction. Due to the combined influences of gravity and the entrained particles' own inertia, the particles tend to be thrown off by centrifugal force into a suitably positioned ash hopper.

The problem with current designs is that the recirculation ducts are usually positioned at the back end of the recirculating apparatus and are thus in close proximity to the generator burners. So situated, the ducts may interfere with the burner piping and with the withdrawal of the burner and lighter. As a result, replacement and maintenance of the burners and their ancillary equipment is often time consuming and difficult.

Clearly, an apparatus that permits expeditious flue gas recirculation while simultaneously overcoming the enumerated difficulty is desirable.

SUMMARY OF THE INVENTION

The disclosed invention surmounts the aforementioned difficulty. By utilizing the instant invention, the recirculation ducts are located at the front end of the recirculating apparatus, thus increasing the access area in the vicinity of the generator burners.

Briefly, the gas recirculating apparatus includes a suitably shaped housing with integral ash hoppers. The interior of the apparatus is equipped with a plurality of triangular-shaped, hollow flow channels disposed above the ash hoppers. The apparatus is in flow communication with the gas exiting the generator. Most of the gas entering the apparatus will not be recirculated and exits through the main exit located in the front of the apparatus. The recirculated gas flows into the interior of the apparatus and exits through a recirculation duct located in the front of the apparatus.

The internal components of the apparatus are specifically arranged to provide a serpentine flow path for the flue gas destined to be recirculated to the generator.

BEST MODE FOR CARRYING OUT THE INVENTION

Figure 1:
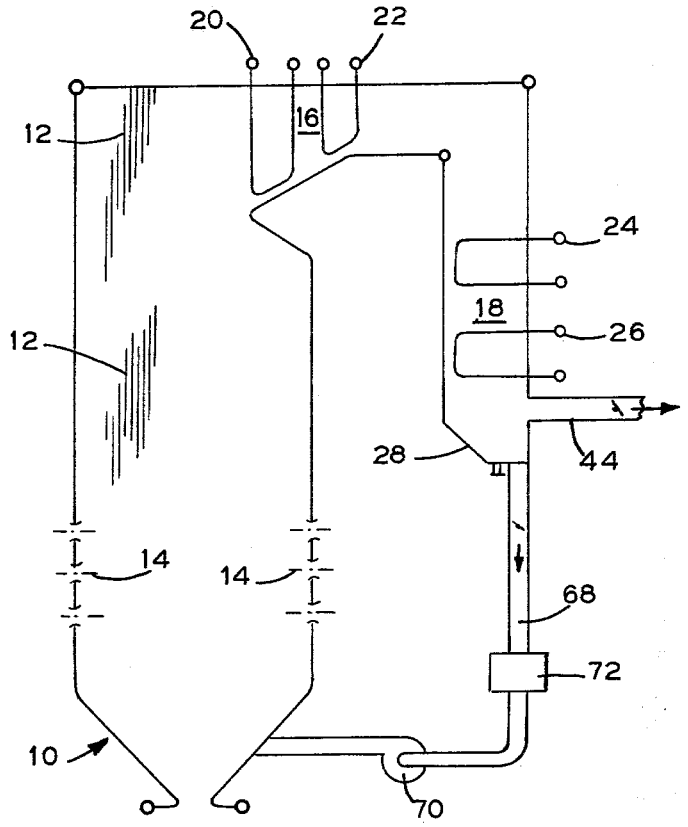
FIG. 1 is a schematic side elevation of a vapor generator embodying the invention.

FIG. 1 is a schematic view of a pulverized coal (P.C.) fired vapor generator 10. It should be understood, however, that the invention may be utilized with other types of vapor generators as well.

The walls of the generator 10 are lined with tubes 12. A fluid (usually water) is circulated through the tubes 12. As the water courses through the tubes 12, it absorbs the heat generated within the generator 10 by heat radiation and/or heat convection. Fuel (pulverized coal in this instance) is fed to the burners 14 wherein the fuel burns in the presence of previously introduced combustion air. The resulting heated gases and the combustion by-products pass upwardly through the generator 10 in heat exchange relationship with the tubes 12, through horizontal convection pass 16 and finally through vertical gas pass 18 before ultimately exiting from the generator 10. A major portion of the gas is then routed to an air heater (not shown) via main exit gas conduit 44 before it is discharged into a stack (not shown). If necessary, the gas may be passed through various types of pollution control equipment (not shown) as well.

Generally, the horizontal convection pass 16 includes secondary superheater 20 and reheater 22. The vertical convection pass 18 frequently includes primary superheater 24 and economizer 26.

As was discussed previously, for purposes of controlling steam temperature, a portion of the flue gas, called recirculated gas, is usually withdrawn from the exiting flue gas stream and returned to the generator 10. Recirculation of the flue gas is accomplished by gas recirculation apparatus 28 and the associated recirculation conduit 68. A fan 70 is employed to induce recirculation flow.

Figure 3:
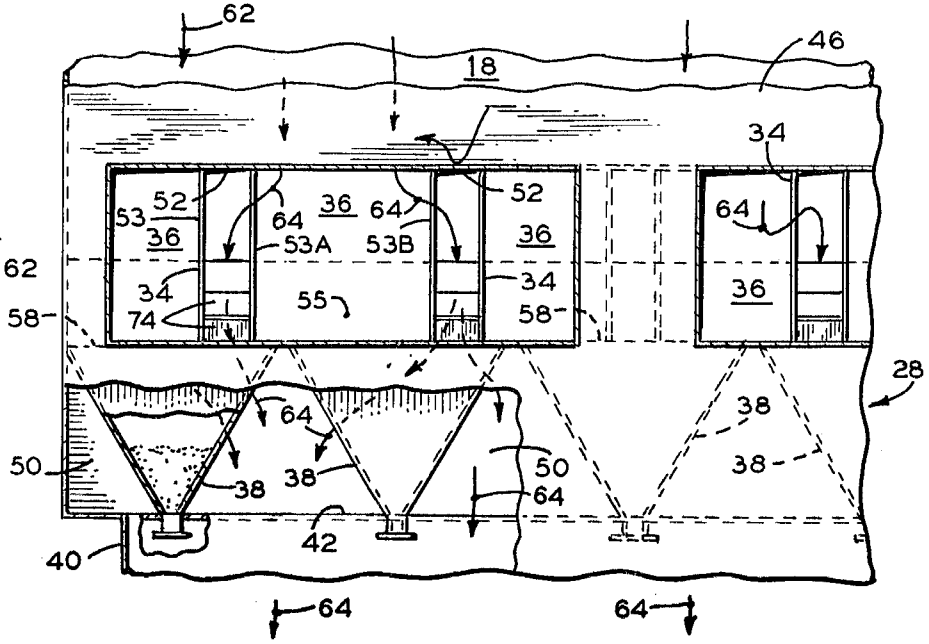
FIG. 3 is a front view of the invention partially cut away.
Figure 2:
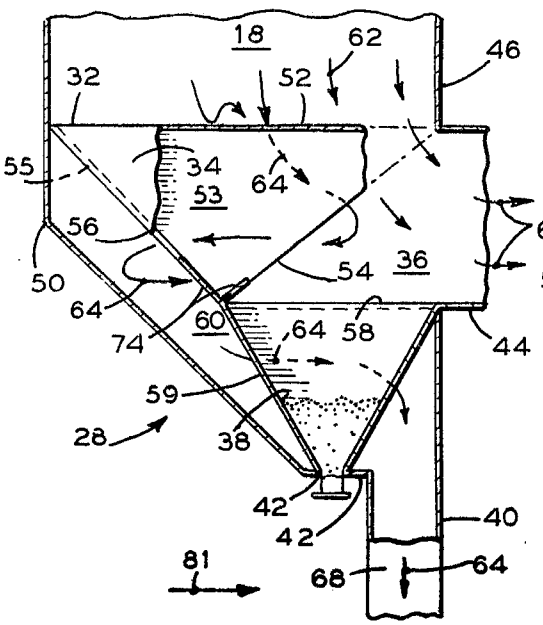
FIG. 2 is a side view of the invention partially cut away.

Referring to FIGS. 2 and 3, the gas recirculation apparatus 28 is shown in greater detail. Arrow 81 indicates the direction of the front of the apparatus 28. The upper face 32 of the apparatus 28 is partially open and in flow communication with the vertical gas pass 18. A plurality of triangular-shaped hollow flow channels 34 divide the upper portion of the apparatus 28 into a multiplicity of discrete flow passages 36.

Flow passage 36 is defined by the side walls 53 of adjacent flow channels (see for example 53*a* and 53*b*) and inclined plate member 55. Member 55 is rectangularly shaped and is obliquely situated, occupying plane 56. Plate member 55 urges most of the flue gas to make a 90° turn toward the front of apparatus 28, thereby exiting through conduit 44. Much of the particulate entrained in the flue gas precipitates out onto plate 55 during said turn and slides down member 55 into ash hopper 38. Member 55 is located on both sides of flow channel 34.

The typical flow channel 34 is a hollow box, shaped like a triangle, disposed so that the triangle peak is pointing downward. The base 52 of channel 34 is a solid rectangular-shaped member extending from the back to the front of pass 18. The vertical sides 53 of channel 34 are solid, triangular-shaped members, whose peaks point downward and whose oblique edges define planes 54 and 56. There are no side members occupying planes 54 and 56, thereby giving channel 34 its hollow nature.

While the flow channels themselves are hollow, having no members in either plane 54 or 56, planes 54 and 56 are partially occupied by inclined plates 74.

Inclined plates 74 provide support for the flow channels and, depending upon the length of plate 74 in planes 54 and 56, provide a degree of control over the flow of gas through the flow channels.

Disposed below flow channels 34, but not necessarily in alignment therewith, are a series of ash hoppers 38. Normally closed, means are provided (not shown) to empty the hoppers 38 of collected particulate matter at periodic intervals. The upper faces 58 of the hoppers 38 are open. The oblique faces of hopper 38, of which face 59 is typical, are closed.

Situated adjacent to and in front of the hopper 38 is recirculation duct 40. The front side of duct 40 extends from the bottom of conduit 44 downward where it joins conduit 68. The back side of duct 40 extends from the bottom face 42 of apparatus 28 downward where it joins conduit 68. Duct 40 is in flow communication with conduit 68.

Main exit gas conduit 44, in flow communication with passages 36, extends outwardly from the front face 46 of the apparatus 28, providing egress for the bulk of the flue gas, i.e. the gas not being recirculated.

The back face 50 of apparatus 28 is composed of an upper portion and a lower portion. The upper portion is a vertically disposed member which extends downward from and in the same plane as the back of vertical gas pass 18. The lower portion of back face 50 is a member extending obliquely from the bottom of the upper portion of back face 50 to bottom face 42. Back face 50, bottom face 42, back face 59 and member 55 define flow space 60.

The only way in which the gas may enter flow space 60 is via flow channel 34. The sides of plate member 55 are sealably attached to the side walls 53 of adjacent flow channels. The bottom edge of member 55 is sealably attached to the upper edge of back face 59 of the ash hoppers, said upper edges of adjacent hoppers being sealably attached to one another. Therefore, the only available route to flow space 60 is through flow channels 34.

The gas recirculation apparatus 28 and the manner of applying it may be better understood by a brief discussion of the principles underlying it.

The apparatus 28 is designed to provide a serpentine flow passage for the recirculated gas, said flow passage represented by flow line 64. The recirculated gas, after coming down pass 18, undergoes an initial turn of approximately 90° as it turns to flow from the area between adjacent channels toward flow channel 34. This first turn is best illustrated in FIG. 3. The recirculated gas then makes a second 90° turn as the gas turns to flow through channel 34. This second turn is best illustrated in FIG. 2. These turns, due to the effects of gravity and the inertia of the particulate matter, cause a large portion of the particulate matter to drop into ash hoppers 38.

Most of the flue gas coming down pass 18 will follow the path of least resistance which means it will turn to pass through conduit 44. This flow is indicated by flow line 62. While this gas is not recirculated, the change in flow direction causes particulate matter from said main flue gas stream to drop into hopper 38. This gas, after exiting apparatus 28 via conduit 44, is destined to be discharged to a stack (not shown).

The recirculated gas, after moving through channel 34 toward the rear of apparatus 28, enters flow space 60. Rebounding off back face 50, the recirculated gas turns roughly 180° and moves toward the front of apparatus 28. Passing along both sides of hoppers 38, said gas moves forward until it reaches duct 40. At this point the direction of flow changes 90° as the gas moves vertically down duct 40. From duct 40, the recirculated gas enters conduit 68, passes therethrough to dust collector 72, and from there will eventually be introduced to generator 10, hence completing the circuit.

The disclosed invention has a number of advantages over the prior art. As mentioned earlier, by positioning the recirculation duct 40 and conduit 68 in front of the recirculation apparatus 28, more room is made available in the general area surrounding the generator burners 14, thereby enhancing the accessibility and facilitating the maintenance of said burners and ancillary equipment. Additionally, because the back and bottom faces of apparatus 28 and the front side of duct 40 envelope hoppers 38, the entire exterior of apparatus 28 may be insulated and lagged thereby eliminating the need for individually lagged and insulated exposed hoppers. Furthermore, recirculation conduit 68 may be shorter thereby reducing pressure line losses. Also, the ash hoppers 38 may be hidden inside apparatus 28 thereby ensuring a more streamlined external appearance.

While in accordance with the provisions of the statutes, there is illustrated and described herein specific embodiments of the invention, those skilled in the art will understand that changes may be made in the form of the invention covered by the claims, and certain features of the invention may sometimes be used to advantage without a corresponding use of the other features.

The embodiments of the invention in which an exclusive property or privilege is claimed are defined as follows:

1. An apparatus for receiving particulate entrained flue gas from a vapor generator and returning a portion of the flue gas for recirculation through the generator, the apparatus comprising:

a. a plurality of spaced flow channels in flow communication with the flue gas being discharged from the generator;

b. a plurality of plate members, each plate member being interposed between adjacent flow channels to define flow passages therebetween, the plate members causing the flue gas to change direction and flow through the passages;

c. a conduit in flow communication with said flow passages for conducting out of the apparatus that part of the flue gas which is not recirculated, said conduit located on a side of the apparatus which faces away from the generator;

d. a plurality of ash hoppers disposed below the plate members for receiving particulate matter which precipitates out of the flue gas;

e. a flow space disposed so as to receive the flue gas which has passed through the channels and direct said gas to flow between the hoppers;

f. a recirculation duct situated below and on the same side of the apparatus as said conduit thereby facilitating access to the generator, said duct being in flow communication with the gas flowing between the hoppers, said duct providing egress for the recirculated gas out of the apparatus, g. a multiplicity of gas turns within the apparatus producing a serpentine gas path between the discharge of flue gas from the generator and the recirculation duct.

2. The apparatus of claim 1 wherein said flow space is defined by said plate members, a side of said ash hoppers, and back and bottom faces of the apparatus.

3. The apparatus of claim 2 wherein said recirculation duct has a side extending vertically downward from the conduit and where said side and the back and bottom faces of the apparatus envelope the ash hoppers within the interior of the apparatus.

* * * * *